US011336993B2

(12) United States Patent
Casadei et al.

(10) Patent No.: US 11,336,993 B2
(45) Date of Patent: May 17, 2022

(54) COMPRESSION DRIVER

(71) Applicant: B&C SPEAKERS S.p.A., Bagno a Ripoli (IT)

(72) Inventors: Andrea Casadei, Bagno a Ripoli (IT); Valentina Cardinali, Bagno a Ripoli (IT)

(73) Assignee: B & C SPEAKERS S.P.A., Bagno a Ripoli (IT)

( * ) Notice: Subject to any disclaimer, the term of this patent is extended or adjusted under 35 U.S.C. 154(b) by 0 days.

(21) Appl. No.: 17/119,463

(22) Filed: Dec. 11, 2020

(65) Prior Publication Data

US 2021/0195319 A1 Jun. 24, 2021

(30) Foreign Application Priority Data

Dec. 19, 2019 (IT) ..... 102019000024799

(51) Int. Cl.

| | |
|---|---|
| ***H04R 25/00*** | (2006.01) |
| ***H04R 1/30*** | (2006.01) |
| ***G10K 9/13*** | (2006.01) |
| ***H04R 9/06*** | (2006.01) |

(52) U.S. Cl.

CPC ..... *H04R 1/30* (2013.01); *G10K 9/13* (2013.01); *H04R 9/06* (2013.01); *H04R 2400/13* (2013.01)

(58) Field of Classification Search

CPC ..... H04R 1/30; H04R 2400/13; H04R 9/06

USPC ..... 381/340

See application file for complete search history.

(56) References Cited

U.S. PATENT DOCUMENTS

2006/0034475 A1* 2/2006 Geddes ..... H04R 1/345 381/343

2015/0373445 A1* 12/2015 Voishvillo ..... H04R 1/30 381/150

FOREIGN PATENT DOCUMENTS

| | | | |
|---|---|---|---|
| EP | 2640089 | A | 9/2013 |
| JP | 2016082369 | A | 5/2016 |
| WO | 2014081092 | A1 | 5/2014 |

* cited by examiner

*Primary Examiner* — Phylesha Dabney

(74) *Attorney, Agent, or Firm* — Cantor Colburn LLP

(57) ABSTRACT

A compression driver including an acoustic outlet duct, a magnetic assembly having a permanent magnet and an air gap, a vibrating membrane with a movable coil adapted and configured to move inside the air gap, where the vibrating membrane includes a first face facing a first chamber communicating with the outlet duct, where the first chamber is a compression chamber, a second face opposite to the first face and facing a second chamber communicating with the air gap and opposite to the first chamber, where the compression driver includes at least one acoustic connection duct which puts in communication the second chamber with the acoustic outlet duct.

12 Claims, 4 Drawing Sheets

COMPRESSION DRIVER

TECHNICAL FIELD

This application is related to and claims the benefit of Italian Patent Application Number 102019000024799 filed on Dec. 19, 2019, the entire contents of which are incorporated by reference herein.

FIELD OF THE INVENTION

The present invention relates to the technical field of audio reproduction systems, and in particular it is directed to a compression driver.

BACKGROUND ART

An electro-acoustic transducer is an audio system device adapted to convert an electrical signal into acoustic waves. A particular type of known acoustic transducers comprise at least one sound source in audio band such as, for example a compression driver, and an acoustic waveguide, called horn.

The horn comprises an internally hollow main body which extends between an inlet opening adapted to receive an acoustic radiation and an outlet opening for diffusing said acoustic radiation outside the horn. The main body has inner walls which delimit a tapered duct allowing the propagation of the acoustic radiation between the inlet opening and the outlet opening. The inlet opening generally is called throat of the horn, while the outlet opening generally is called mouth of the horn.

At least one compression driver may be fastened to the throat of the horn in certain acoustic transducers. An example of compression driver of the known art is described in Patent EP 2 640 089 B1.

A compression driver generally comprises a housing which houses at least one vibrating membrane having two opposite faces. One of the two faces of the vibrating membrane is facing a compression chamber communicating with at least one acoustic outlet duct. Such at least one acoustic outlet duct conducts the acoustic waves generated by the movement of the vibrating membrane up to the outlet port of the compression driver and therefore, up to the horn inlet, i.e., up to the throat of the horn.

A movable coil fed by with electrical signal is fastened to the vibrating membrane. The compression driver further comprises a magnetic assembly having an air gap inside which the movable coil is free to move. The other of the two faces of the vibrating membrane closes a further chamber opposite to the compression chamber and which in fact, is a second compression chamber.

During operation, the air closed inside the second compression chamber is compressed and decompressed due to the movement of the vibrating membrane, due to the movement of the coil. Thereby, the air contained in the second compression chamber opposes a certain resistance to the movement of the vibrating membrane, which restricts the low frequency response of the compression driver. Conventionally, the rigidity of the suspensions of the vibrating membrane is reduced to extend the low frequency response in compression drivers. However, this may not be sufficient or may not be possible due to design constraints.

Document WO 2014/081092 A1 describes a driver having a complex and bulky structure because it requires an outer cover, having a front cover and a rear cover, and an inner cover. An acoustic connection duct at least partly extends between the inner cover and the outer cover. A driver having just as complex and bulky a structure is also described in document JP 2016 082369 A.

It is the object of the present invention to provide a compression driver which allows to solve, or at least partially reduce, the drawbacks described above with reference to the prior art compression drivers.

Such an object is achieved by a compression driver as generally defined in claim 1. Preferred and advantageous embodiments of the aforesaid compression driver are defined in the appended dependent claims.

The invention will be better understood from the following detailed description of a particular embodiment given by way of explanation and, therefore, not by way of limitation, with reference to the accompanying drawings briefly described in the following paragraph.

DETAILED DESCRIPTION

Figure 1:
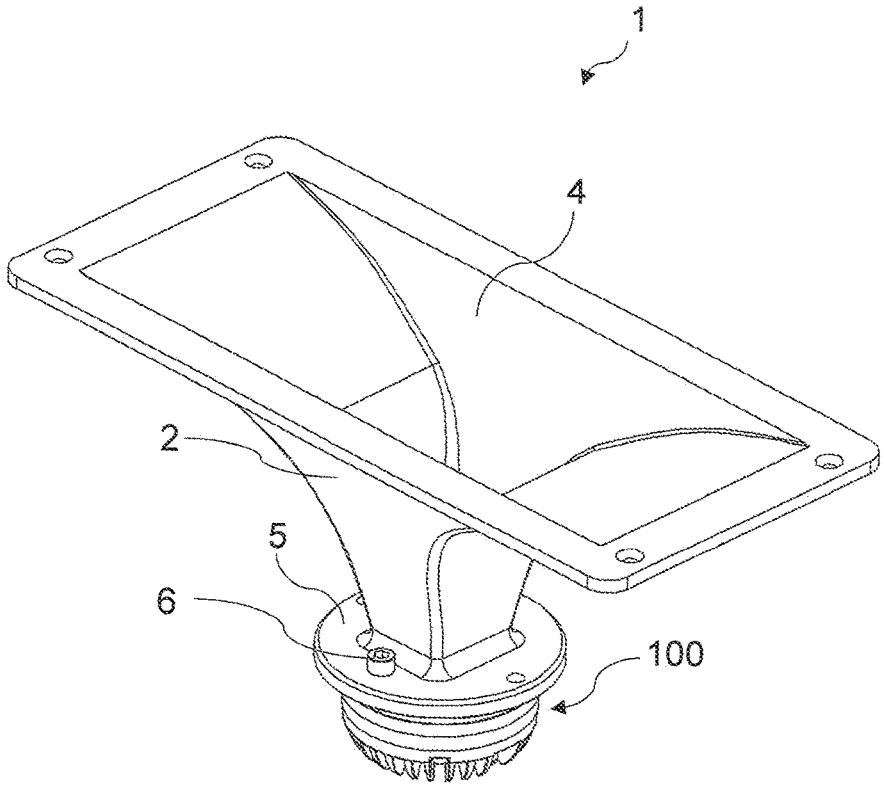
FIG. 1 shows a top three-dimensional view of a non-limiting embodiment of an electro-acoustic transducer, comprising a horn and a compression driver coupled to the horn.
Figure 2:
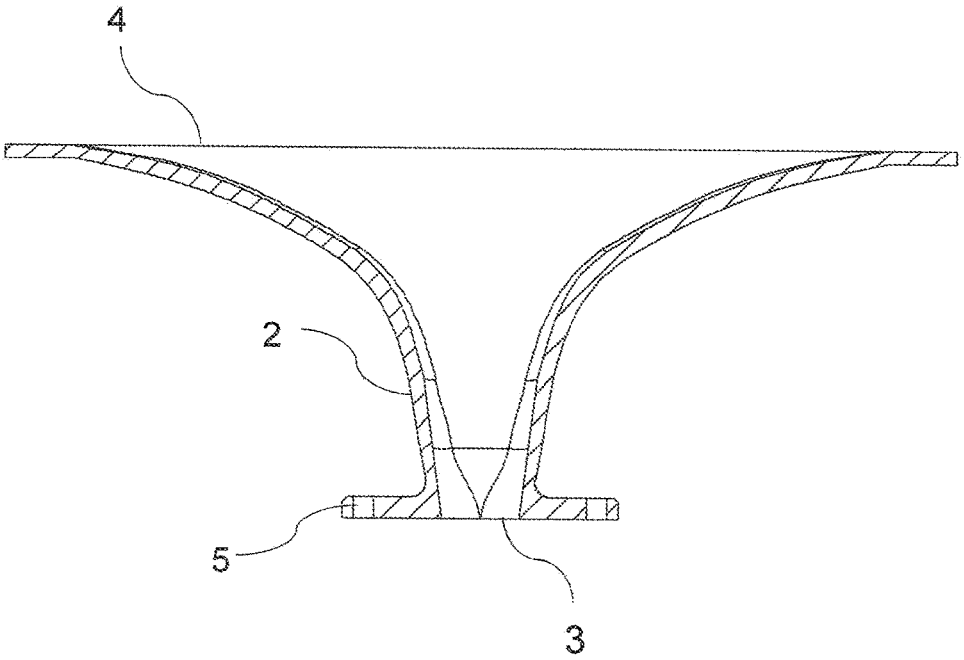
FIG. 2 shows a side sectional plan view of the horn in FIG. 1.

FIG. 1 shows a non-limiting embodiment of an electro-acoustic transducer 1.

In the particular embodiment shown, the electro-acoustic transducer 1 comprises a compression driver 100 and a horn 2, which are operatively connected to each other, for example by means of a mechanical coupling system. In the particular example shown in FIG. 1, horn 2 is mechanically coupled to the compression driver 100 by means of a coupling flange 5 and an associated screw system 6.

Horn 2 has an internally hollow main body which extends between an inlet opening 3 adapted to receive an acoustic radiation in audio band emitted by the compression driver 100, and an opposite outlet opening 4 for diffusing such an acoustic radiation outside horn 2. The inlet opening 3 generally is called throat of horn 2, while the outlet opening 4 generally is called mouth of horn 2.

The main body of horn 2 has walls which delimit a tapered duct allowing the propagation of the emitted acoustic radiation between the inlet opening 3 and the outlet opening 4, i.e., between the throat and the mouth. In the non-limiting example shown in the accompanying drawings, the outlet opening 4 is quadrangular in shape, rectangular in the example.

The main body of horn 2 may be made of a plastic or metal material, e.g., of aluminum.

Figure 3:
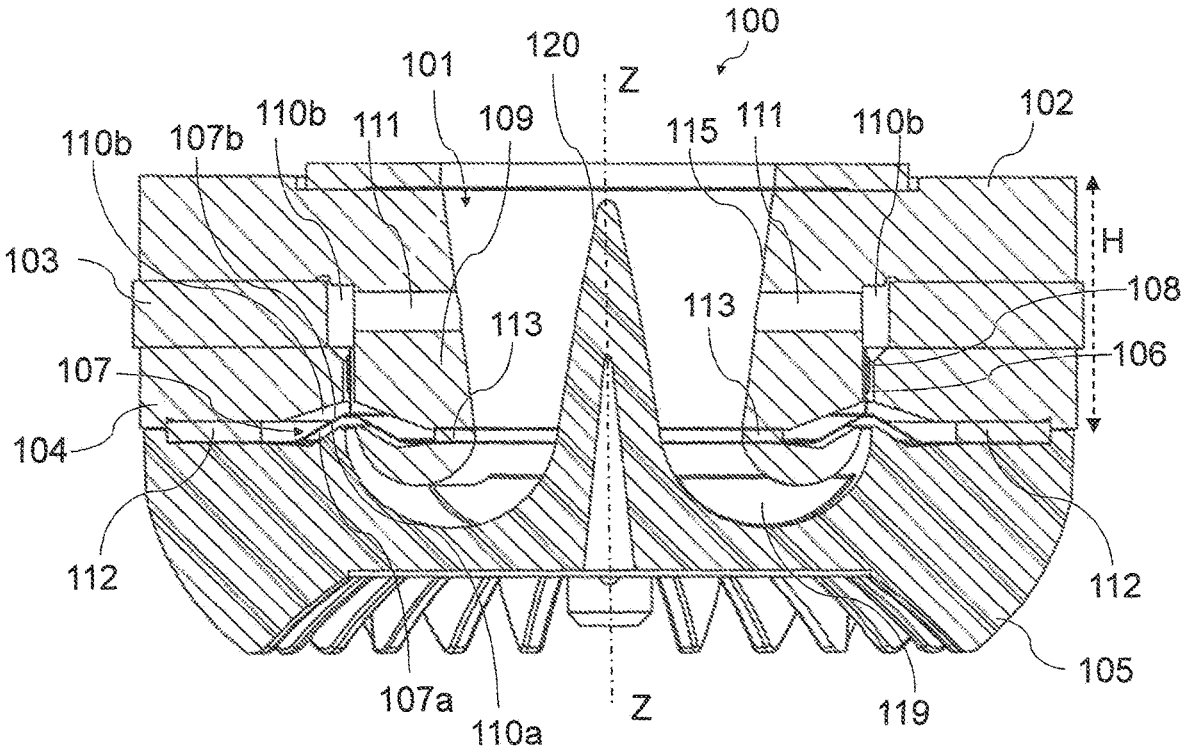
FIG. 3 shows a side sectional plan view of the compression driver in FIG. 1.
Figure 4:
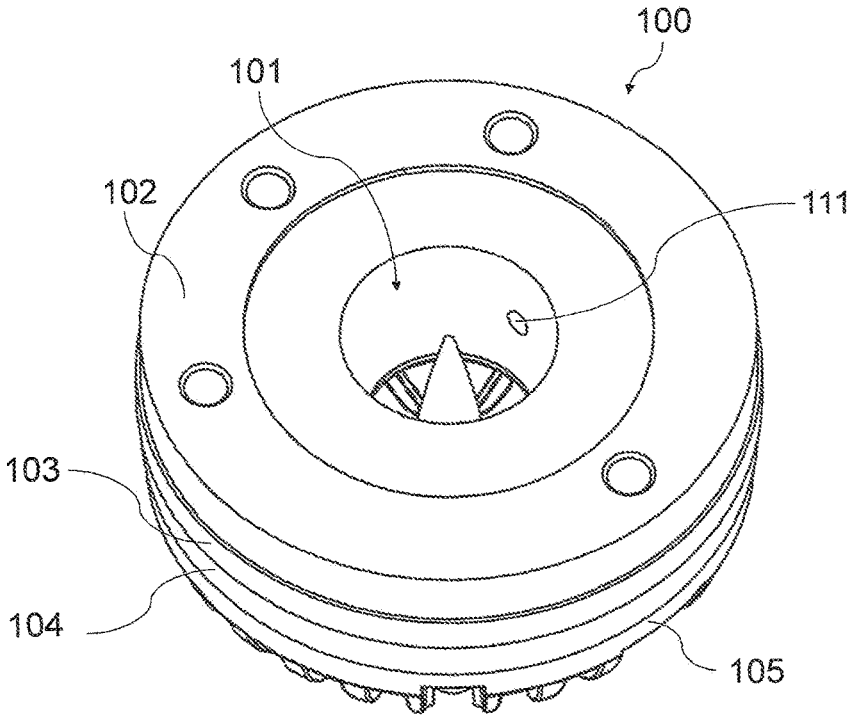
FIG. 4 shows a top axonometric view of the compression driver in FIG. 3.

With reference to FIGS. 3 and 4, a first embodiment of the compression driver 100 is now described.

The compression driver 100 comprises an acoustic outlet duct 101 which is adapted and configured to be coupled to the throat 3 of horn 2. Such an acoustic duct 101 preferably is a tapered duct, in particular a duct which cross section progressively widens in the direction approaching the throat 3 of horn 2. The acoustic outlet duct 101 is preferably delimited by a side wall 115.

The compression driver 100 further comprises a magnetic assembly 102, 103, 104, or magnetic motor, comprising a permanent magnet 103 and an air gap 106. For example, the permanent magnet 103 has an annular shape and therefore is provided with a central through hole.

In addition to the permanent magnet 103, the magnetic assembly 102, 103, 104 comprises a ferromagnetic structure 102, 104. Conveniently, the compression driver 100 comprises a cap 105 fastened to the magnetic assembly 102, 103, 104. Cap 105 is preferably made of plastic or metal material, for example it is made of hard plastic or aluminum.

The compression driver 100 further comprises a vibrating membrane 107 comprising a movable coil 108 adapted and configured to move inside the air gap 106. The movable coil 108 has a coil axis Z-Z. When the movable coil 108 is fed with an electrical signal, it is configured to move axially, i.e., along the coil axis Z-Z, with respect to the magnetic assembly 102, 103, 104 and to vibrate the vibrating membrane 107. Axis Z-Z shown in the accompanying drawings is also the axis of the acoustic outlet duct 101.

In the embodiment in FIGS. 3 and 4, the vibrating membrane 107 is an annular membrane and is fastened to a radially outer support ring 112 and a radially inner support ring 113.

The compression driver 100 preferably is a driver for medium-high frequencies and has, for example without introducing any limitation, a frequency response equal to 1 kHz to 20 kHz.

The vibrating membrane 107 comprises a first face 107*a* facing a first chamber 110*a* communicating with the outlet duct 101. The first chamber 110*a* is a compression chamber. The vibrating membrane 107 further comprises a second face 107*b* opposite to the first face 107*a* and facing a second chamber 110*b* communicating with the air gap 106 and opposite to the first chamber 110*a*.

The first chamber 110*a* and the second chamber 110*b* are conveniently arranged so that if the volume of one of the two chambers expands due to the vibration of membrane 107, the volume of the other chamber contracts, and vice versa. This clarifies the meaning of the term "opposite" used in the preceding paragraph in relation to the first chamber 110*a* and to the second chamber 110*b*.

The compression driver 100 comprises at least one acoustic connection duct 111 that puts in communication the second chamber 110*b* with the acoustic outlet duct 101. It has been noted that the presence of the aforesaid acoustic connection duct 111 actually allows to extend the low frequency response of the compression driver 100. Preferably, the acoustic connection duct 111 extends between an inlet opening which faces into the second chamber 110*b* and an outlet opening which faces into the acoustic outlet duct 101. More preferably, such an acoustic duct 111 is an entirely rectilinear duct for matters of increased production simplicity.

According to an advantageous embodiment, the outlet opening of the acoustic connection duct 111 is defined on the side wall 115 of the acoustic outlet duct 101.

According to an advantageous embodiment, the at least one acoustic connection duct 111 entirely extends into the thickness of the magnetic assembly 102, 103, 104. In other words, in such an embodiment, the at least one acoustic connection duct 111 extends along the whole length thereof into the thickness of the magnetic assembly 102, 103, 104. Thereby, with reference, for example to FIG. 3, the acoustic connection duct 111 extends into a space which does not exceed the axial volume H of the magnetic assembly. By virtue of the contrivance, the compression driver 100 has a highly compact structure.

According to an advantageous embodiment, the at least one acoustic connection duct 111 is a hole, preferably having circular cross section, defined in the magnetic assembly 102, 103, 104.

According to a particularly advantageous embodiment, the aforesaid acoustic connection duct 111 and the second compression chamber 110*b* serve as, i.e., define a, Helmholtz resonator. Advantageously, such a Helmholtz resonator has a resonance frequency calculated so as to agree with the volume of the second chamber 110*b*, the force factor BL and the rigidity of the vibrating membrane 107 so that the whole system operates harmoniously as a single system in order to avoid phase shifts between the acoustic waves encountering one another in the acoustic outlet duct 111 from the first face 107*a* and from the second face 107*b*, respectively, of the vibrating membrane 107.

For the purposes of Helmholtz resonator tuning, it should be noted that a vibrating membrane mounted in a closed structure which is such as to define a rear compression chamber in the case of a compression driver of the known art, has a frequency response with a behavior of high-pass filter in low frequency. In the case of mounting in a closed structure, the introduction of at least one connection duct 111 allows to extend lower the lower frequency of the frequency response at the cost of a rising of the order of the filter.

The selection of the final shape of the frequency response in any case is not univocal, i.e., it is possible to select between different "alignments" or tunings. Simplifying the problem, the preselected tuning determines the combined specifications of four parameters: resonance frequency of the mechanical part $f_s$ (determined by the mechanical suspensions and by the movable mass), speaker volume $V_B$ (which is an additional pneumatic suspension and which here, is equal to the volume of the second chamber 110*b*), loss ratio $Q_T$ (mechanical and electrical, whereby also dependent on the motor and the movable coil $Bl^2/R_E$) and additional resonance frequency $f_H$ generated by the acoustic connection duct 111.

In particular, the additional resonance frequency $f_H$ is a function of the combined pneumatic suspension system given by the air in the speaker (acoustic compliance $C_B$), in which the speaker here is the second chamber 110*b*, and of the mass of the air (acoustic mass $M_H$) in the connection duct 111:

$$f_H = \frac{1}{2\pi\sqrt{C_B M_H}}.$$

The acoustic compliance $C_B$ is simply determined by the volume of the speaker $V_B$ as:

$$C_B = \frac{V_B}{\rho c^2}$$

where ρ is the density of the air and c is the speed of sound, while the acoustic mass $M_H$ can be calculated from the air mass $M_{air}$ in the acoustic connection duct 111 and from section A of such a duct 111, as:

$$M_H = \frac{M_{air}}{A^2} = \frac{\rho l}{A}$$

where l is the length of the acoustic connection duct 111.

The following formula for directly selecting the resonance frequency $f_H$, or tuning frequency $f_H$, of the Helmholtz resonator according to the system dimensions is obtained from the aforesaid relations:

$$f_H = \frac{c}{2\pi}\sqrt{\frac{A}{lV_B}}.$$

Several of the most common alignments require $f_H \leq f_B$, where $f_B$ is the frequency of the system without connection duct 111, which is set apart from $f_s$ since the pneumatic suspension of the closed speaker is also considered. This simple condition allows an approximate preliminary tuning of the system, without first making reference to a specific alignment.

For completeness, it is specified that the disclosure described particularly refers to a direct radiation speaker, in which the speaker and the system of the connection duct 111 are essentially subjected to the same external acoustic load. This clearly is not absolutely true in the case of a compression driver, considering that the vibrating membrane 107 faces a compression chamber. However, conceptually the strategy described may similarly be applied to manipulate the low frequency response of a compression driver.

According to an advantageous embodiment, the magnetic assembly 102, 103, 104 comprises a ferromagnetic structure having a first ferromagnetic plate 102 and a second ferromagnetic plate 104 between which the permanent magnet 103 is interposed and said at least one acoustic connection duct 111 extends into the first ferromagnetic plate 102 or into the second ferromagnetic plate 104. However, this does not exclude embodiments in which the acoustic connection duct 111 extends into the permanent magnet 103.

For example, if the first ferromagnetic plate 102 comprises a pole piece 109, it is advantageous for the acoustic connection duct 111 to extend, preferably entirely, into the pole piece 109. In this regard, the acoustic connection duct 111 may be made in a convenient manner by perforating the pole piece 109, for example by means of a cutter or drill. According to a preferred embodiment, the permanent magnet 103 has a through hole and the pole piece 109 is shaped so as to be inserted in the through hole.

According to an advantageous embodiment, the pole piece 109 has a central hole which is coaxial with the outlet duct 101, and the acoustic connection duct 111 laterally extends into the pole piece 109, i.e., radially or transversely, with respect to the central hole.

According to a preferred embodiment, the acoustic connection duct 111 extends radially with respect to axis Z-Z of the movable coil 108, which is also the axis of the acoustic outlet duct 101. Advantageously, the acoustic connection duct 111 solely extends, i.e., over the whole length thereof, radially or transversely with respect to axis Z-Z of the movable coil 108.

In the embodiment shown in FIGS. 3 and 4, the compression driver 100 comprises two acoustic connection ducts 111. However, the number of acoustic ducts can be equal to one or even greater than two.

According to an advantageous embodiment, the acoustic connection duct 111 has a circular cross section. Such a circular cross section may be constant along the whole acoustic connection duct 111 or variable along at least one segment of the acoustic connection duct 111.

Again with reference to FIGS. 3 and 4, it should be noted that a non-limiting embodiment is shown in which the compression driver 100 comprises a connecting duct 119 operatively interposed between the compression chamber 110*a* and the acoustic outlet duct 101. Such a connecting duct 119 preferably is also such as to deflect the generated acoustic radiation outlet from the first compression chamber 110*a* by 180°, or about 180°, in other words, such a duct is a U-shaped or substantially U-shaped connection. According to a preferred embodiment, the aforesaid connecting duct 119 has an increasing cross section in the direction from the first chamber 110*a* to the acoustic outlet duct 101. In other words, such a duct 119 is a connecting and expansion duct.

The aforesaid connecting duct 119 is preferably defined inside cap 105, and more preferably has a circular symmetry about axis Z-Z of the movable coil 108.

According to the embodiment shown in FIGS. 3 and 4, the compression driver 101 comprises an ogive 120 housed in the acoustic outlet duct 101. The ogive 120 preferably is a conical element having cylindrical symmetry, and for example is fastened to cap 105, made for example in a single piece with the latter. The acoustic outlet duct 101 is preferably radially delimited in the outer wall of the ogive 120 and is radially delimited outside the side wall 115.

Figure 5:
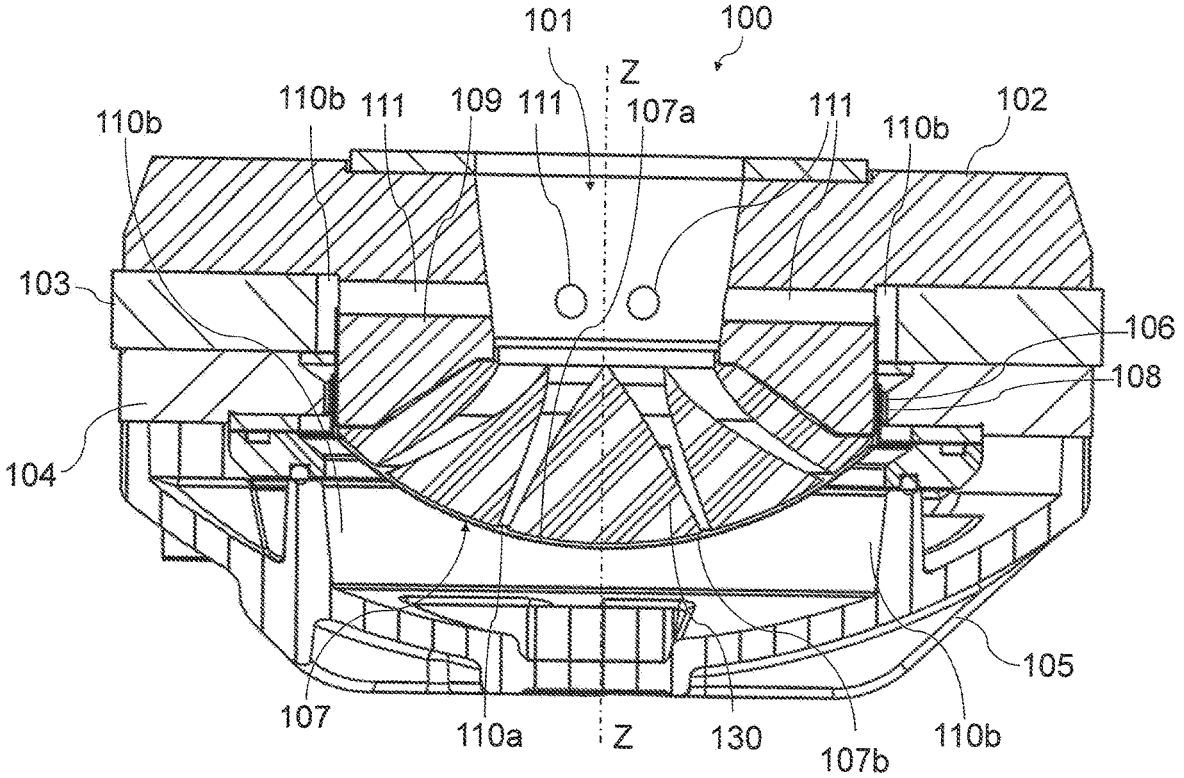
FIG. 5 shows a side sectional plan view of a first possible embodiment variant of the compression driver in FIG. 3.

FIG. 5 shows a second embodiment of a compression driver 100 which differs from the embodiment in FIGS. 3 and 4 substantially in that the compression driver 100 therein has a dome-shaped vibrating membrane 107. In this embodiment, the compression driver 101 does not have the ogive 120 and instead is provided with an acoustic equalizer 130. The first compression chamber 110*a* is defined between the first face 107*a* of the vibrating membrane 107 and the lower face of the acoustic equalizer 130. The second chamber 110*b* is formed by two chamber portions, of which a first portion is defined between the second face 107*b* of the vibrating membrane 107 and cap 105, and the second portion is defined in the ferromagnetic structure 102, 104, and in particular in the first ferromagnetic plate 102. The two chamber portions fluidically communicate with each other through the air gap 106.

In the embodiment in FIG. 5, four acoustic connection ducts 111 are provided, only by mere way of example.

Figure 6:
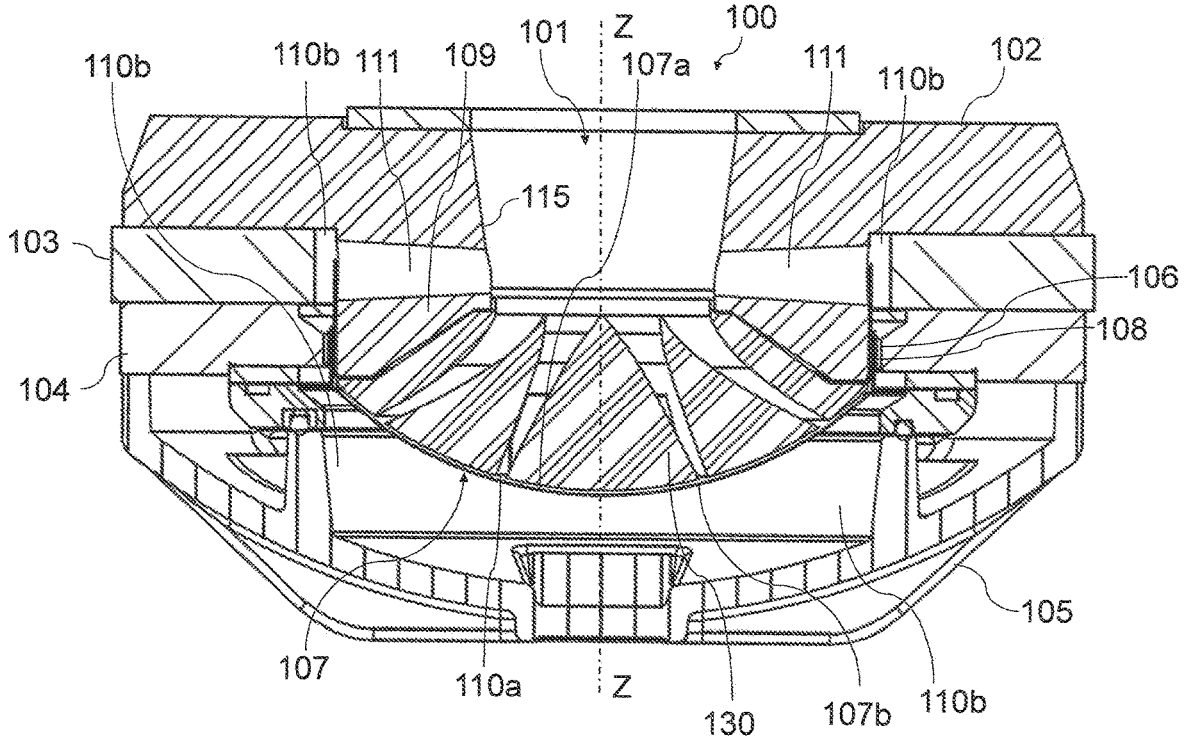
FIG. 6 shows a side sectional plan view of a second possible embodiment variant of the compression driver in FIG. 3.

FIG. 6 shows a third embodiment of a compression driver 100 which differs from the embodiment in FIG. 5 substantially in that the compression driver 100 therein comprises acoustic connection ducts 111 which have a variable, preferably circular, cross section. In the non-limiting embodiment in FIG. 6, the aforesaid cross section is particularly progressively decreasing in the direction from the second compression chamber 110*b* to the acoustic outlet duct 101. In the embodiment in FIG. 6, two diametrically-opposite acoustic connection ducts 111 are provided, only by mere way of example.

Figure 7:
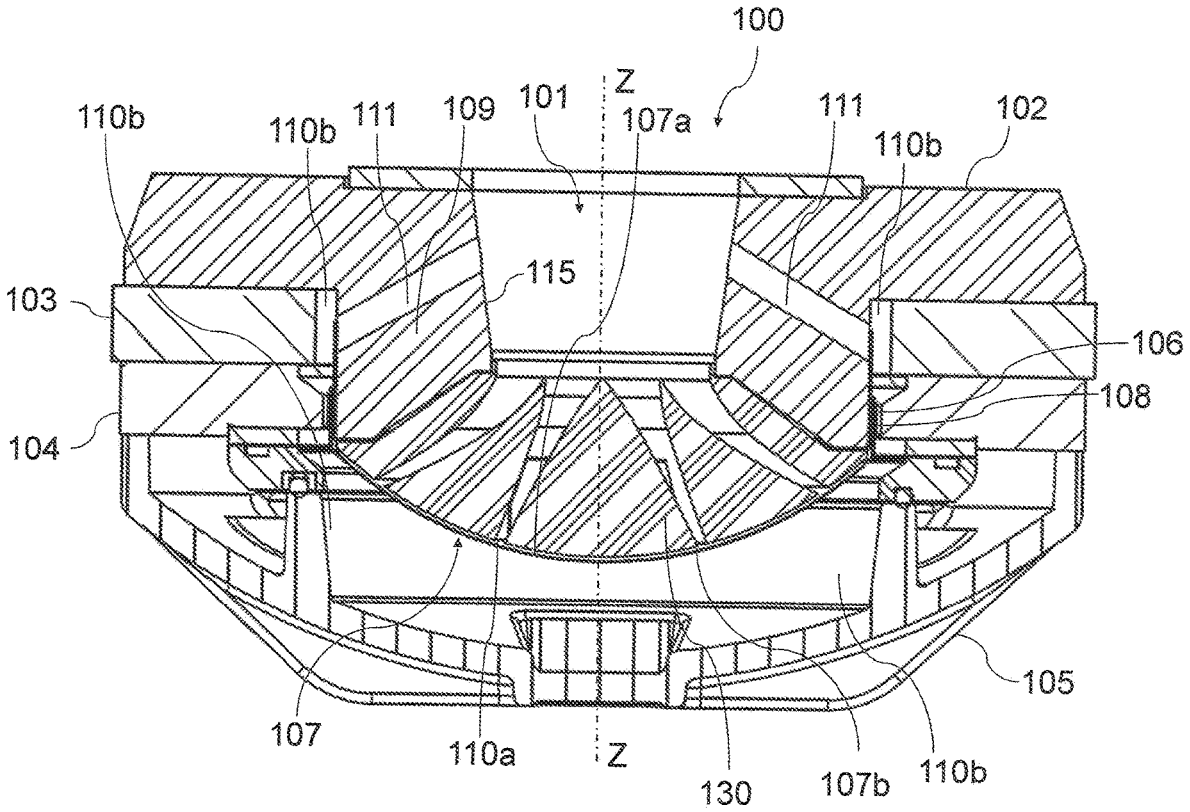
FIG. 7 shows a side sectional plan view of a third possible embodiment variant of the compression driver in FIG. 3.

FIG. 7 shows a fourth embodiment of a compression driver 100 which differs from the embodiments in FIGS. 5 and 6 substantially in that the compression driver 100 therein comprises acoustic connection ducts 111, each of which longitudinally extends along a respective axis which is tilted with respect to axis Z-Z of the movable coil 108, for example tilted by about 45° with respect to axis Z-Z. In the embodiments in FIGS. 3 to 6, the acoustic ducts instead extend along respective axes which are perpendicular to axis Z-Z of the movable coil 108. In the embodiment in FIG. 7, two diametrically-opposite acoustic connection ducts 111 are provided, only by mere way of example.

Finally, it should be noted that although embodiments have been shown in which the acoustic connection duct 111 extends into the ferromagnetic structure 102, 104, this contrivance, albeit advantageous and preferred, is not essential or limiting. As mentioned above, embodiments are indeed possible in which the acoustic connection duct 111 extends into the permanent magnet 103. Moreover, it should be noted that it is not essential for the acoustic connection duct 111 to be rectilinear, because it could, for example be curved or "L"-shaped, etc.

From the above, it is apparent that a compression driver 100 of the type described above allows to fully achieve the preset objects in terms of overcoming the drawbacks of the prior art. Indeed, by virtue of the presence of at least one acoustic connection duct 111, it has indeed been noted that excellent results are obtained in terms of low frequency extension of the frequency response of the compression driver 100.

Without prejudice to the principle of the invention, the embodiments and the manufacturing details may be broadly varied with respect to the above description disclosed by way of a non-limiting example, without departing from the scope of the invention as defined in the appended claims.

The invention claimed is:

1. A compression driver comprising:

an acoustic outlet duct;

a magnetic assembly comprising a permanent magnet and an air gap;

a vibrating membrane comprising a movable coil adapted and configured to move inside the air gap;

wherein the vibrating membrane comprises:

a first face facing a first chamber communicating with the acoustic outlet duct, wherein the first chamber is a compression chamber;

a second face opposite to the first face and facing a second chamber communicating with the air gap and opposite to the first chamber;

wherein the compression driver further comprises an acoustic connection duct which puts in communication the second chamber with the acoustic outlet duct;

wherein the magnetic assembly comprises a ferromagnetic structure having a first ferromagnetic plate and a second ferromagnetic plate between which the permanent magnet is interposed, and wherein the acoustic connection duct extends into the first ferromagnetic plate or into the second ferromagnetic plate or into the permanent magnet; and wherein the first ferromagnetic plate comprises a pole piece having a central hole which is coaxial with the outlet duct, and wherein the acoustic connection duct laterally extends into the pole piece, radially or transversely, with respect to the central hole.

2. The compression driver according to claim 1, wherein the acoustic connection duct extends between an inlet opening which faces into the second chamber and an outlet opening which faces into the acoustic outlet duct.

3. The compression driver according to claim 1, wherein the acoustic connection duct entirely extends into a thickness of the magnetic assembly.

4. The compression driver according to claim 1, wherein the permanent magnet has a through hole, and wherein the pole piece is shaped so as to be inserted into the through hole.

5. The compression driver according to claim 1, wherein the movable coil has a coil axis, and wherein the acoustic connection duct extends radially with respect to the coil axis.

6. The compression driver according to claim 5, wherein the acoustic connection duct only extends radially or transversely with respect to the coil axis.

7. The compression driver according to claim 1, wherein the compression driver comprises a plurality of acoustic connection ducts.

8. The compression driver according to claim 1, wherein the acoustic connection duct has a circular cross section.

9. The compression driver according to claim 8, wherein the circular cross section changes along a segment of the acoustic connection duct.

10. The compression driver according to claim 1, wherein the acoustic connection duct is entirely rectilinear.

11. The compression driver according to claim 1, wherein the acoustic connection duct and the second compression chamber define a Helmholtz resonator.

12. An electro-acoustic transducer comprising a horn and a compression driver according to claim 1, operatively coupled to the horn.

* * * * *